United States Patent [19]

Häberle

[11] Patent Number: 4,856,119

[45] Date of Patent: Aug. 15, 1989

[54] HELMET WITH THREE-POINT CHIN STRAP

[75] Inventor: Hermann Häberle, Ulm-Unterweiler, Fed. Rep. of Germany

[73] Assignee: Romer GmbH, Neu-Ulm, Fed. Rep. of Germany

[21] Appl. No.: 226,620

[22] Filed: Aug. 1, 1988

[30] Foreign Application Priority Data

Aug. 1, 1987 [DE] Fed. Rep. of Germany ... 8710581[U]

[51] Int. Cl.[4] ..... A42B 1/22; A42B 7/00

[52] U.S. Cl. ..... 2/417; 2/421

[58] Field of Search ..... 2/421, 417

[56] References Cited

U.S. PATENT DOCUMENTS

| | | | |
|---|---|---|---|
| 4,044,400 | 8/1977 | Lewicki et al. | 2/421 |
| 4,398,306 | 8/1983 | Gooding | 2/421 |
| 4,445,253 | 5/1984 | Howey | 2/421 |
| 4,461,044 | 7/1984 | Reiterman et al. | 2/421 |

FOREIGN PATENT DOCUMENTS

| | | | |
|---|---|---|---|
| 0259516 | 3/1988 | European Pat. Off. | 2/417 |

*Primary Examiner*—Werner H. Schroeder
*Assistant Examiner*—D. Price
*Attorney, Agent, or Firm*—Herbert Dubno

[57] ABSTRACT

A helmet for protecting a head according to this invention has a hard shell generally symmetrical to a longitudinal plane and having a rear edge normally juxtaposed with the nape of the neck of the wearer and a pair of front temple regions flanking the plane and normally juxtaposed with the temples of the wearer, a rear center strap having two ends and lying generally on the plane and a pair of similar side straps generally symmetrically flanking the plane and each having a rear end fixed to the other end of the center strap and a front end secured to the helmet at the respective temple region. The one end of the center strap is adjustably secured to the shell at the rear edge therefor generally on the plane. Respective fittings are slidable on the side straps between the ends thereof and a chin strap extends between the fittings and normally passes under the chin of the wearer.

7 Claims, 2 Drawing Sheets

HELMET WITH THREE-POINT CHIN STRAP

FIELD OF THE INVENTION

The instant invention relates to a helmet for protecting the head for occupational or sport purposes. More particularly this invention concerns such a helmet having a chin strap with a three-point attachment.

BACKGROUND OF THE INVENTION

A standard helmet is known, for example from German utility model 8,306,006 which is secured to the wearer's head by a strap assembly comprising a pair of side straps each having a rear end attached in the back of the helmet and a front end attached at the temple region, and a chin strap passing from the center region of the one side strap to the center region of the opposite side strap. Normally fittings are provided on the side straps that allow attachment of the chin strap to the side straps and a releasable buckle or clasp is provided at one end of the chin strap to allow easy removal of the helmet.

In the known system the side straps are permanently fixed at their rear ends on the helmet, but are fitted to any of several different attachment location at the front temple region of the helmet so their lengths can be adjusted. In addition the fittings on the side straps where the chin strap is attached are of the self-binding type can slide easily when no tension is applied to them, but that cannot slide when the chin strap pulls on them.

As a result it is fairly difficult to adjust such a helmet. The ends of the side straps must both be set, and then the positions of both side-strap fittings. Finally the length of the chin strap must be set. Clearly such complicated adjustment is disadvantageous.

OBJECTS OF THE INVENTION

It is therefore an object of the present invention to provide an improved helmet of the above-described type.

Another object is to provide such a helmet which is easy to adjust and which is particular adapted for a cyclist.

SUMMARY OF THE INVENTION

A helmet for protecting a head according to this invention has a hard shell generally symmetrical to a normally vertical longitudinal plane and having a rear edge normally juxtaposed with the nape of the neck of the wearer and a pair of front temple regions flanking the plane and normally juxtaposed with the temples of the wearer, a rear center strap having two ends and lying generally on the plane, and a pair of similar side straps generally symmetrically flanking the plane and each having a rear end fixed to the other end of the center strap and a front end secured to the helmet at the respective temple region. The one end of the center strap is adjustably secured to the shell at the rear edge thereof generally on the plane. Respective fittings are slidable on the side straps between the ends thereof and a chin strap extends between the fittings and normally passes under the chin of the wearer.

With the system of this invention, therefore, it is possible to adjust the tightness of the strap assembly simply by shortening or lengthening the rear center strap. This action simultaneously adjusts both side straps identically and, since the wearer's head is invariably symmetrical and the hat is invariably worn on center, this adjustment will automatically be what is desired.

According to another feature of this invention the rear ends of the side straps are unitary with each other. In fact the side straps can be formed of a common piece of strapping that is folded at and stitched to the other end of the center strap. Such construction is extremely simple and strong. The fold makes it possible to relatively easily set the angle the side straps form with the center strap.

According to yet another feature of the current invention each fitting is formed with three throughgoing slits generally forming an equilateral triangle and each side strap passes through all three of the slits of the respective fitting.

It is possible according to this invention for the front ends of the side straps to be fixed to the helmet at the respective temple regions. They may also be adjustably secured to the respective temple regions.

In order to make the rear center strap adjustable the helmet is formed at the rear edge with three generally parallel throughgoing slits through which the one end of the center strap passes in a loop. These slits are just a little wider than the width of the strap to keep the rear strap centered. A similar arrangement of three slits can be used at each temple region if for some reason it is desired to individually adjust the side straps.

DESCRIPTION OF THE DRAWING

The above and other objects, features, and advantages will become more readily apparent from the following, reference being made to the accompanying drawing in which.

SPECIFIC DESCRIPTION

Figure 1:
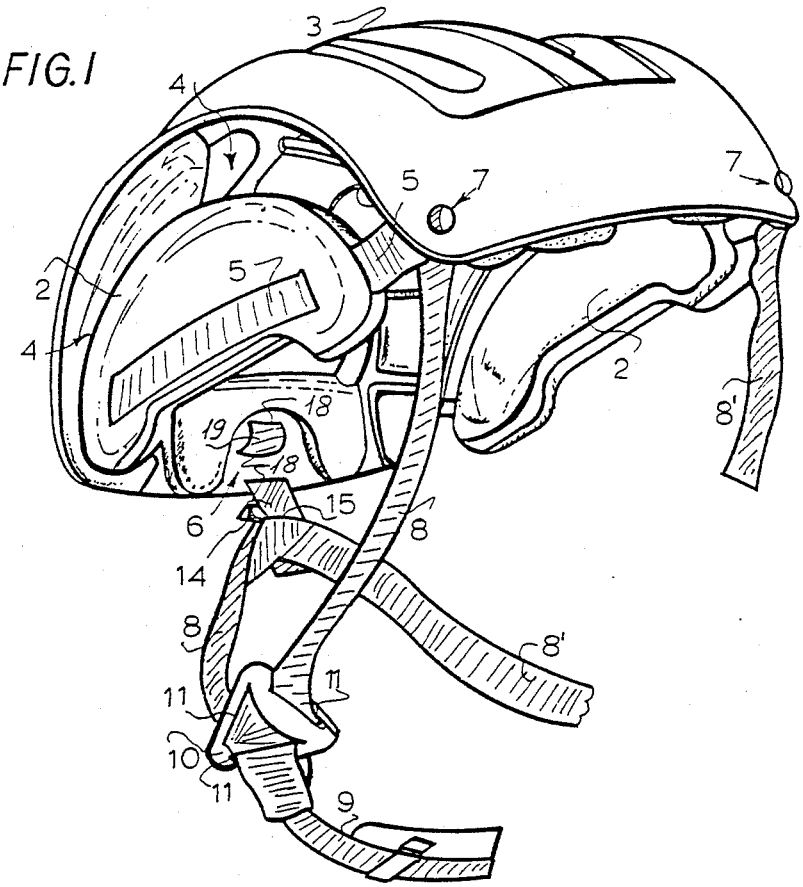
FIG. 1 is a partly broken-away perspective view of the helmet and strap assembly according to this invention.
Figure 2:
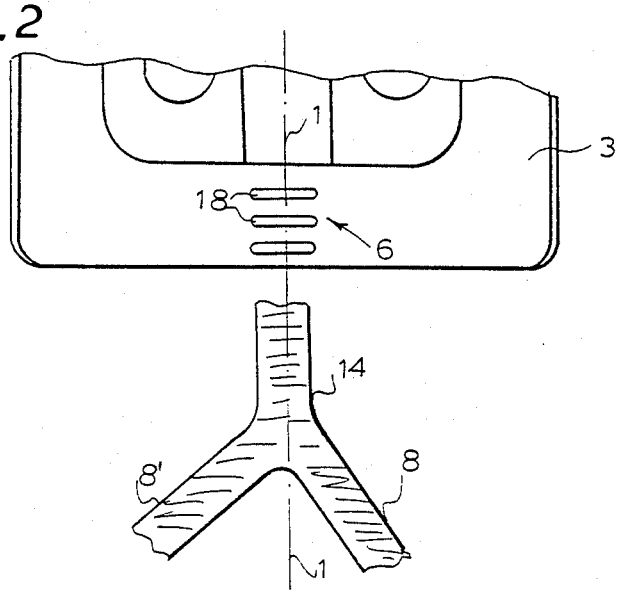
FIG. 2 is a front view of a detail of the helmet and strap with, once again, some parts broken away for clarity of view.

As seen in FIG. 1 a standard cyclist's helmet as described in German utility model 8,702,777 has a main center part 3 centered on a longitudinal plane 1—1 (FIG. 2) flanked by a pair of side parts 2 forming with the center part 3 a pair of downwardly U-shaped cutouts 4. A helmet strap 5 runs circumferentially around the parts 2 and 3 in a plane perpendicular to the plane 1—1 and can be shortened to reduce the size of the helmet or lengthened to increase it, as is known per se.

According to this invention the helmet parts 2, 3 are secured to the wearer's head by a strap assembly attached at a central rear-edge attachment location 6 lying on the plane 1—1 and at a pair of front temple locations 7 symmetrically flanking this plane 1—1. This strap assembly comprises a pair of identical side straps 8 and 8' that are in fact formed of a single piece of strapping and that each carry a respective side fitting 10 and a chin strap 9 secured between the fittings 10 and normally running under the jaw or chin of the wearer.

Figure 3:
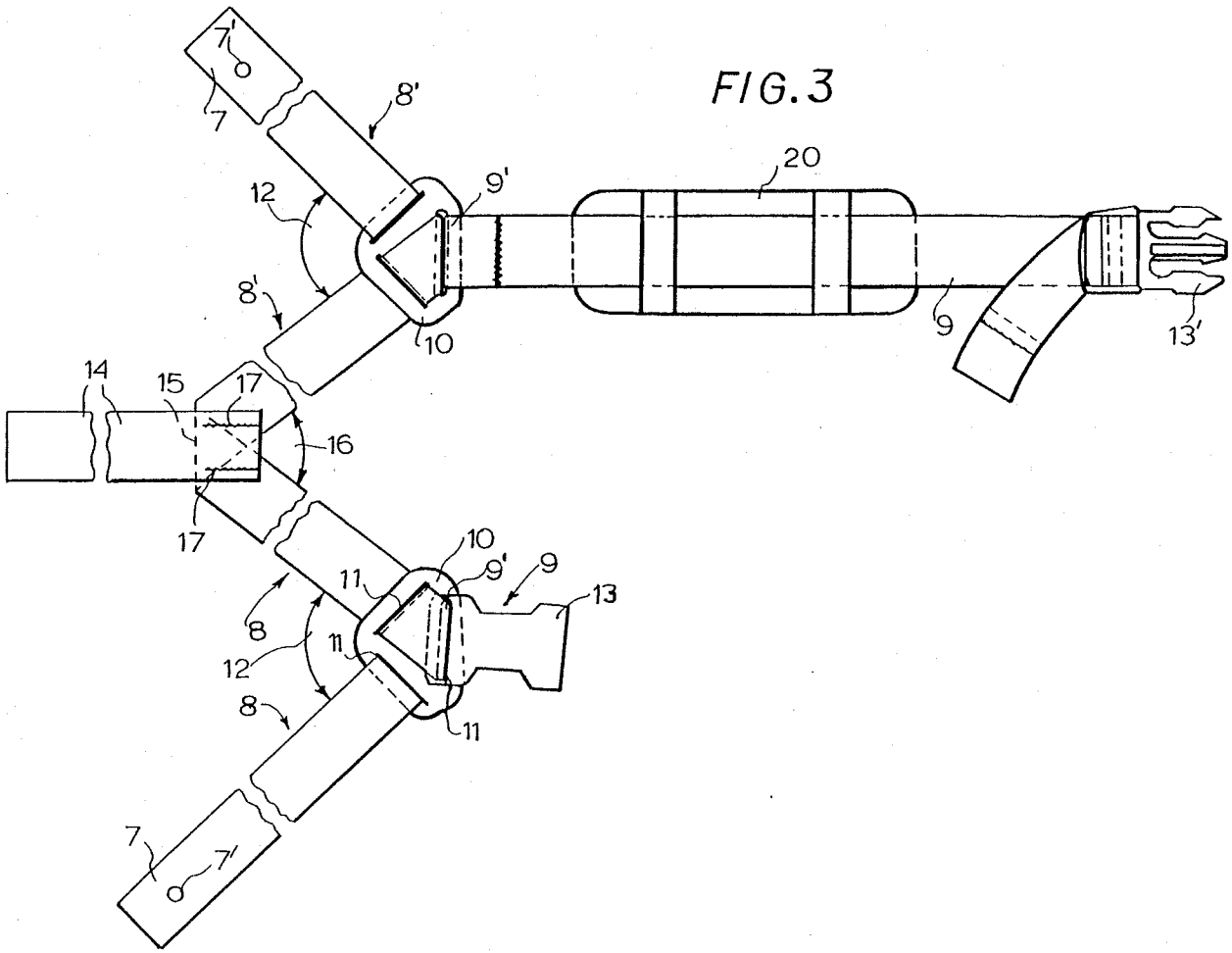
FIG. 3 is a top view of the strap assembly flattened out to show all its parts.

The side strap 8, which is fully shown in FIG. 1 and which is identical to the strap 8', passes through three throughgoing slits 11 in the fitting 10 so that as seen in FIG. 3 it enters and exits this fitting 10 at a right angle 12. At its front end the side strap 8 has a snap or rivet 7' by means of which it is attached at the respective temple region 7. In addition the ends of the chin strap 9 are looped through one of the slits 11. Thus it is possible for the fittings 10 to be slid along the straps 8 and 8' although when there is some pull on the fittings 10 they do not slide. The chin strap 9 is provided with a cushion 20 and with a pair of matable fittings 13 and 13' allowing this strap 9 to be opened to remove the helmet.

The strapping forming the two straps 8 and 8'; is folded at 15 to form an angle 16 that is roughly right and is secured by stitching 17 to the lower end of the rear strap 14. The upper end of this strap 14 is woven as a loop 19 through three throughgoing parallel slits 18 in the rear region 6 of the helmet part 3. Thus it is relatively easy, when there is no tension in the strap 14, to slide it in the slits 18 and adjust its length. This automatically also, of course, adjusts the side straps 8 and 8'.

I claim:

1. A helmet for protecting a head, the helmet comprising:

a hard shell generally symmetrical to a longitudinal plane and having a rear edge normally juxtaposed with the nape of the neck of the wearer and a pair of front temple regions flanking the plane and normally juxtaposed with the temples of the wearer;

a rear center strap having two ends and lying generally on the plane;

means on the helmet at the rear edge thereof and generally on the plane for adjustably securing one end of the center strap to the helmet;

a pair of similar side straps generally symmetrically flanking the plane and each having a rear end fixed to the other end of the center strap and a front end secured to the helmet at the respective temple region;

respective fittings slidable on the side straps between the ends thereof; and a chin strap extending between the fittings and normally passing under the chin of the wearer.

2. The helmet defined in claim 1 wherein the rear ends of the side straps are unitary with each other.

3. The helmet defined in claim 2 wherein the side straps are formed of a common piece of strapping that is folded at and stitched to the other end of the center strap.

4. The helmet defined in claim 2 wherein each fitting is formed with three throughgoing slits generally forming an equilateral triangle and each side strap passes through all three of the slits of the respective fitting.

5. The helmet defined in claim 2 wherein the front ends of the side straps are fixed to the helmet at the respective temple regions.

6. The helmet defined in claim 3, further comprising means for adjustably securing the fronts of the side straps to the respective temple regions.

7. The helmet defined in claim 1 wherein the helmet is formed at the rear edge with three generally parallel throughgoing slits through which the one end of the center strap passes in a loop.

* * * * *